US010456652B2

(12) United States Patent
Mack

(10) Patent No.: US 10,456,652 B2
(45) Date of Patent: Oct. 29, 2019

(54) GOLF SWING TRAINING ASSEMBLY AND METHOD OF OPERATION

(71) Applicant: Jesse Mack, Williamsville, NY (US)

(72) Inventor: Jesse Mack, Williamsville, NY (US)

( * ) Notice: Subject to any disclaimer, the term of this patent is extended or adjusted under 35 U.S.C. 154(b) by 0 days.

(21) Appl. No.: 15/855,606

(22) Filed: Dec. 27, 2017

(65) Prior Publication Data

US 2019/0192945 A1 Jun. 27, 2019

(51) Int. Cl.
*A63B 69/00* (2006.01)
*A63B 69/36* (2006.01)
*A63B 102/32* (2015.01)

(52) U.S. Cl.
CPC ..... *A63B 69/3673* (2013.01); *A63B 69/3608* (2013.01); *A63B 69/3623* (2013.01); *A63B 2102/32* (2015.10)

(58) Field of Classification Search
CPC ..... A63B 69/3667
USPC ..... 473/218, 207, 217
See application file for complete search history.

(56) References Cited

U.S. PATENT DOCUMENTS 3,372,930 A * 3/1968 Sertich ..... A63B 22/14 473/452
5,000,457 A 3/1991 Brown
5,810,673 A * 9/1998 Castleberry ..... A63B 69/3673 473/217
6,001,026 A 12/1999 Breneman
6,450,895 B1 9/2002 Galluzzo, Jr.
7,125,350 B1 * 10/2006 Reason-Kerkhoff ..... A63B 69/0002 473/452
7,335,117 B2 * 2/2008 Reason-Kerkhoff ..... A63B 69/0002 473/217
7,901,304 B1 3/2011 Moore
7,955,181 B2 * 6/2011 Drollinger ..... A63B 69/3673 473/272
8,133,125 B2 * 3/2012 Park ..... A63B 69/0002 473/218
8,147,347 B2 4/2012 Hooper
9,162,133 B2 10/2015 Schroer

* cited by examiner

*Primary Examiner* — Raeann Gorden
(74) *Attorney, Agent, or Firm* — Vincent G. LoTempio; Kloss, Stenger & LoTempio; David T. Stephenson

(57) ABSTRACT

A golf swing training assembly and method of operation aligns the feet of a golfer at a perfect golf stance; and allows the feet and the body to shift into a correct finish swing. A platform forms a static foundation upon which the golfer stands. A left foot Lazy Susan turntable and a right foot Lazy Susan turntable are operable on the platform to rotate about a central axle in two directions relative to the static platform to accommodate a traveling foot of golfer while swinging. The golfer positions the left foot and right foot on their respective Lazy Susan turntable to practice a golf stance or swing. A foot fastener on each Lazy Susan turntable detachably fastens feet to Lazy Susan turntable during rotation to prevent lateral movement by legs during the golf swing. A rotation restriction mechanism restricts rotation of the Lazy Susan turntables relative to platform.

19 Claims, 16 Drawing Sheets

GOLF SWING TRAINING ASSEMBLY AND METHOD OF OPERATION

FIELD OF THE INVENTION

The present invention relates generally to a golf swing training assembly and method of operation. More so, the present invention relates to a training assembly that helps position the feet and hips in golf movements involving the rotation of the hips, foot placement, follow through, and striking of a golf ball; whereby the assembly provides a training platform that forms a static foundation upon which the golfer stands; whereby a left foot Lazy Susan turntable and a right foot Lazy Susan turntable rotates about a central axle in two directions relative to the platform to follow the feet in their natural rotational movement during the swing; and whereby a rotation restriction mechanism restricts rotation of the Lazy Susan turntables relative to the platform for customizing the type of golf swing and accommodating swinging motions for other sports.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known in the art that striking a golf ball straight and true is difficult and requires skill and training. Fundamentally, if the ball is to fly off the tee straight, the club that hits it must also be squarely aligned. This, of course, depends on how well the golfer has swung the club, which depends on initial stance alignment, and the swinging motion of feet and hips.

Golfers are continually seeking to improve their swing technique in order to maximize both the accuracy and the distance the golf ball travels after contact with the golf club. In the past, the typical golf swing involved throwing the hips forward in the direction that the golfer is attempting to drive the golf ball.

Generally, in striking a golf ball, the golfer should be positioned with the toes of both feet on a line parallel to an imaginary target line for the shot. The stance should also position the ball so that a line intersecting the ball and perpendicular to the target line passes slightly inside of the forwardmost heel of the golfer. Finally, the club face should be "square" to the ball, which is perpendicular to the target line at the point of impact of the club face with the ball.

Further, to swing a golf club or retained to improve the skills required the creation of muscle memory, which is an effective way of learning a golf swing for maximum ball travel distance and directional accuracy. Specifically, if a golfer repeats the desired swing of a golf club multiple times, with the feet, hips, and upper body positioned correctly, the golfer will be able to replicate the feel of the desired golf swing by the use of muscle memory.

In the past, various systems, methods, and golf training devices were designed to repetitively force the golfer to swing a golf club through a certain range of motion. Such prior art systems provide the golfer the opportunity to build muscle memory, but not for all motions of the swing and in many cases not entirely correct motions for a real human golf swing.

Other proposals have involved mats and technological devices for training the positioning of feet during a golf swing. The problem with these golf swing training devices is that they do not align the feet of a golfer at a perfect golf stance at set position; and automatically allow the feet and the body to shift into a perfect finish swing based on the golfer's body type. Even though the above cited golf training systems meet some of the needs of the market, a golf swing training assembly and method of operation that helps position the feet and hips in golf movements involving the rotation of the hips, foot placement, follow through, and striking of a golf ball is still desired.

SUMMARY

Illustrative embodiments of the disclosure are generally directed to a golf swing training assembly and method of operation. The golf swing training assembly is configured to automatically align the feet of a golfer at a perfect golf stance at set position; and automatically allow the feet and the body to shift into a perfect finish swing based on the golfer's body type. The use of a Lazy Susan mechanism enables limited rotation of the golfer during the swing, which trains the feet, legs, hips, and upper body to achieve the perfect golf swing.

In one non-limiting embodiment, the assembly provides a training platform that forms a static foundation upon which the golfer stands. The assembly further provides a left foot Lazy Susan turntable and a right foot Lazy Susan turntable. The Lazy Susan turntables are set apart from each other in an adjacent, shoulder-width distance on the platform. The Lazy Susan turntables rotate about a central axle in two directions relative to the static platform to follow the feet in their natural rotational movement during the swing. Each Lazy Susan turntable may be defined by a generally disc shape.

The golfer positions the left foot and right foot on their respective Lazy Susan turntable to practice a golf stance, a back swing, a down swing, and general body position when striking a golf ball. The golfer initiates the golf swing, and the Lazy Susan turntables rotate to follow the feet in their natural rotational movement during the swing. To help train the feet to the correct position during the swing, a foot fastener may be used on each Lazy Susan turntable to detachably fasten each foot to the Lazy Susan turntable during rotation and to prevent lateral movement by the legs during the golf swing. Further, at least one rotation restriction mechanism may also be operable with the Lazy Susan turntables to restrict or limit the rotation of the Lazy Susan turntables relative to the platform. This restrictive rotation may be useful for customizing the type of golf swing to accommodate different body types and golfing abilities, or accommodating swinging motions for other sports.

In this manner, the training assembly aligns the feet at a perfect golf stance at set position; allows the feet and body to shift into the perfect finish based on body type; allows focus on striking the golf ball; and helps develop golf swing body positioning and muscle memory, so as to correct: inconsistent stances; inconsistent ball strikes; inconsistent direction; inconsistent follow through.

In one non-limiting embodiment, a golf swing training assembly, comprises:

a platform;

a left foot Lazy Susan turntable rotatable in two directions relative to the platform;

a right foot Lazy Susan turntable rotatable in two directions relative to the platform, the right foot Lazy Susan turntable disposed in a spaced-apart, adjacent relationship to the left foot Lazy Susan turntable on the platform;

a left foot fastener disposed on the left foot Lazy Susan turntable, the left foot fastener enabling detachable fastening of a left foot to the left foot Lazy Susan turntable;

a right foot fastener disposed on the right foot Lazy Susan turntable, the right foot fastener enabling detachable fastening of a right foot to the right foot Lazy Susan turntable; and a rotation restriction mechanism operable to selectively restrict rotation of the Lazy Susan turntables in the two directions relative to the platform.

In one aspect, the platform is bifurcated along a central hinge.

In another aspect, the platform further includes a pair of handles for mobility.

In another aspect, the platform is defined by at least one hole.

In another aspect, the Lazy Susan turntables comprise a Lazy Susan mechanism.

In another aspect, the Lazy Susan turntables comprise a static member detachably attached to the platform, a rotatable member rotatable with respect to the static member, a foot support member riding the rotatable member, and a central axle disposed centrally to the static member, the rotatable member, and the foot support member, the central axle being fixedly attached in the at least one hole forming in the platform.

In another aspect, the foot support member is defined by a central aperture for receiving the central axle, whereby the foot support member rotates about the central axle.

In another aspect, the static member, the rotatable member, and the foot support member are defined by a disc shape.

In another aspect, the Lazy Susan turntables are defined by a disc shape having a perimeter.

In another aspect, the rotation restriction mechanism comprises a pair of hasps fixedly attached to the Lazy Susan turntables, the pair of hasps hingedly extending beyond the perimeter of the Lazy Susan turntables, the pair of hasps hingedly retracting within the perimeter of the Lazy Susan turntables, the rotation restriction mechanism further comprising at least one restriction bar detachably attached in the platform to enable selective restriction of rotation by the Lazy Susan turntables.

In another aspect, the at least one restriction bar detachably fits into the at least one hole that forms in the platform.

In another aspect, the foot fasteners comprise a hook and loop fastener.

One objective of the present invention is to automatically align the feet of a golfer at a perfect golf stance at set position; and automatically allow the feet and the body to shift into a perfect finish swing based on the golfer's body type.

Yet another objective is to help train the feet to the correct position during a golf swing.

Yet another objective is to prevent lateral movement by the legs during the golf swing.

Another objective is to adjust the amount of rotation allowed by the Lazy Susan turntables with the rotation restriction mechanism for customizing the type of golf swing to accommodate different body types and golfing abilities, or accommodating swinging motions for other sports.

Yet another objective is to help develop golf swing body positioning and muscle memory, so as to correct: inconsistent stances; inconsistent ball strikes; inconsistent direction; inconsistent follow through.

Yet another objective is to support the weight of a golfer up to 300 pounds.

Yet another objective is to provide an inexpensive to manufacture golf swing training assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1A is the starting position and FIG. 1B is the finished swing position of the feet, in accordance with an embodiment of the present invention;

FIG. 2A is the starting position and FIG. 2B is the finished swing position of the feet, in accordance with an embodiment of the present invention;

FIG. 3A shows a starting position for a right-handed swing with both feet facing straight ahead 90°, FIG. 3B shows the right-handed swing in progress, FIG. 3C shows the finished right-handed swing position with the left foot and respective Lazy Susan turntable rotating about 110°, and the right foot and respective Lazy Susan turntable rotating about 180°, and FIG. 3D shows the finished left-handed swing position with the right foot Lazy Susan turntable rotating approximately 70° and the left foot turning inwardly such that the left foot Lazy Susan turntable rotates approximately 0°, in accordance with an embodiment of the present invention;

FIG. 4A shows a starting position with both feet facing straight ahead 90°, and FIG. 4B shows the finished swing position, in accordance with an embodiment of the present invention;

FIG. 5A shows a rear view of a static member, and FIG. 5B shows a front view of the static member and a rotatable member, in accordance with an embodiment of the present invention;

FIG. 7A shows a front view of the foot support member carrying a left foot strap and a rotation restriction mechanism, and FIG. 7B shows a rear view of t foot support member with a central axle passing through, in accordance with an embodiment of the present invention.

Like reference numerals refer to like parts throughout the various views of the drawings.

DETAILED DESCRIPTION OF THE INVENTION

Figure 1A:
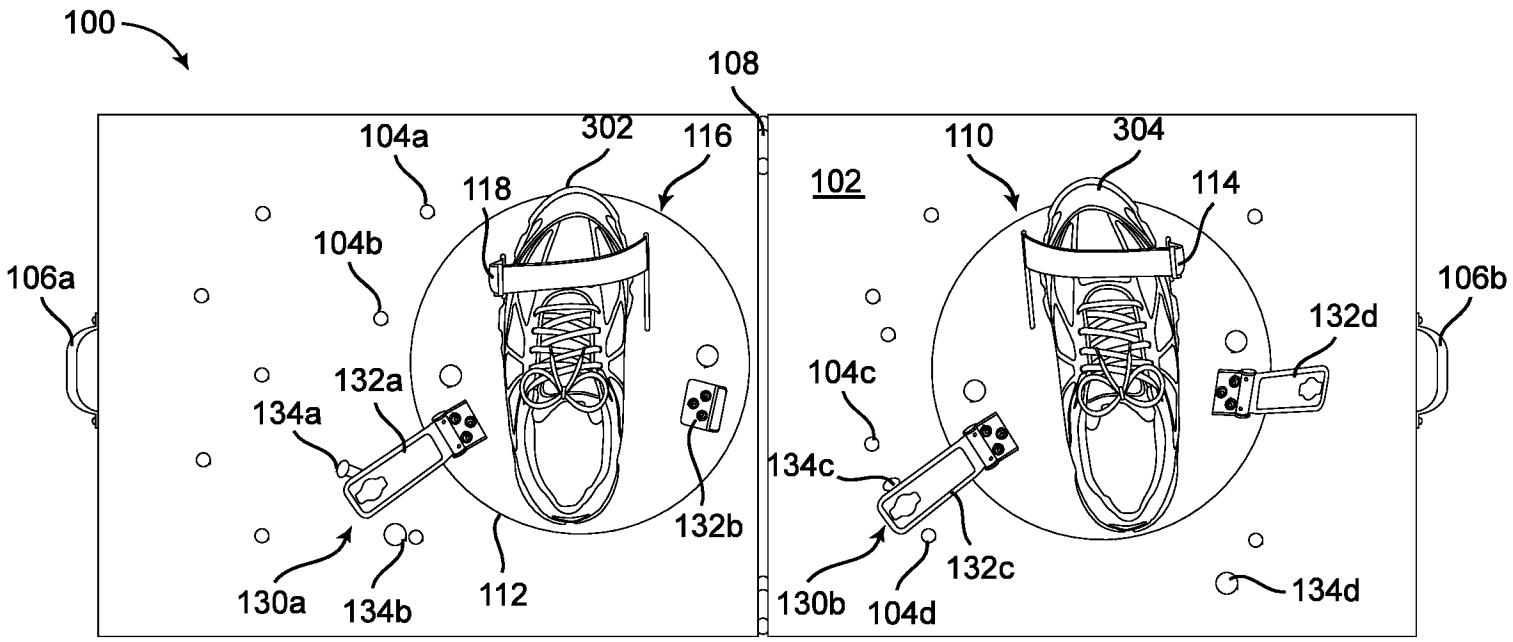
FIGS. 1A and 1B illustrate a top view of an exemplary golf swing training assembly, showing the Lazy Susan turntables rotating in a right-handed swing motion, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A golf swing training assembly 100 and method 200 of operation is referenced in FIGS. 1A-8B. The golf swing training assembly 100, hereafter "assembly 100" is configured to help position the feet and hips in golf movements involving the rotation of the hips, foot placement, follow through, and striking of a golf ball. These rotational training aspects of assembly 100 are adjustable to train swinging motion for other sports beyond golf, such as baseball, tennis, and cricket. Further, the assembly 100 is configured to be ambidextrously operational, training both a right-handed swing and a left-handed swing.

The unique capacity of assembly 100 to train various swings, and from both the right and left handed swinging motion is possible, chiefly because a rotatable Lazy Susan mechanism is used to support and track a golfer 300 during the swing. The Lazy Susan mechanism comprises a right foot Lazy Susan turntable 110 and a left foot Lazy Susan turntable 116 that rotate up to 360° on a static platform 102. The golfer's feet 302, 304 strap into the respective Lazy Susan turntable 116, 110 with a right and left foot fastener 114, 118 and rotate in tandem with the feet during the swing. Lazy Susan turntables 116, 110 rotate to follow the feet 302, 304 in their natural rotational movement during the golf swing. Further, the range of rotation for Lazy Susan turntables 116, 110 is adjusted through use of at least one rotation restriction mechanism 130*a-b*. It is this restriction of rotational range that trains the feet, the hips, and generally the lower body, to the proper golf swing.

Figure 1B:
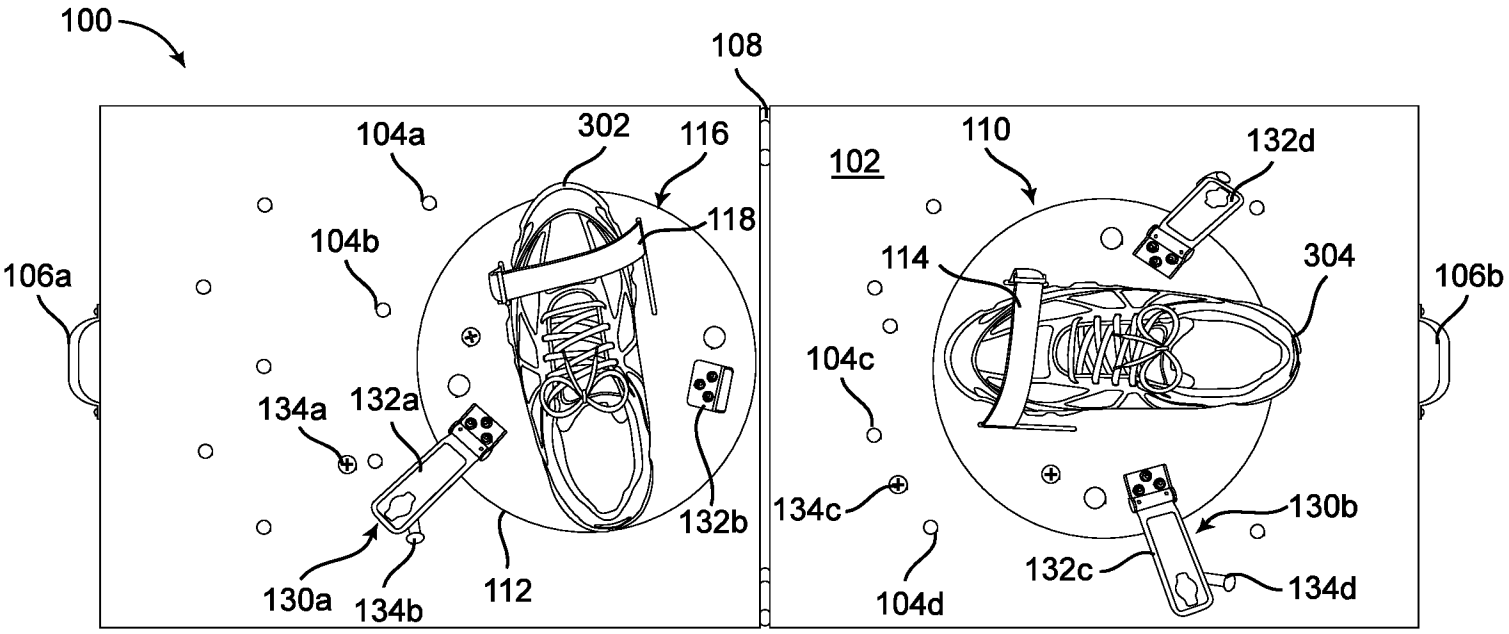

Operating the assembly 100 with a right-handed swing involves standing with both feet 302, 304 facing forward, at about 90° (FIG. 1A). As the golfer 300 swings the golf club with the right hand, driving the golf club, the left foot 302 rotates, turning outwardly, and the left foot Lazy Susan turntable 116 rotates approximately 110°. Simultaneously, the right foot 304 rotates, turning inwardly, and the right foot Lazy Susan turntable 110 rotates approximately 180° (FIG. 1B). The Lazy Susan turntables 116, 110 are restricted from rotating further, which trains the feet 302, 304, and develops muscle memory therein.

Figure 2A:
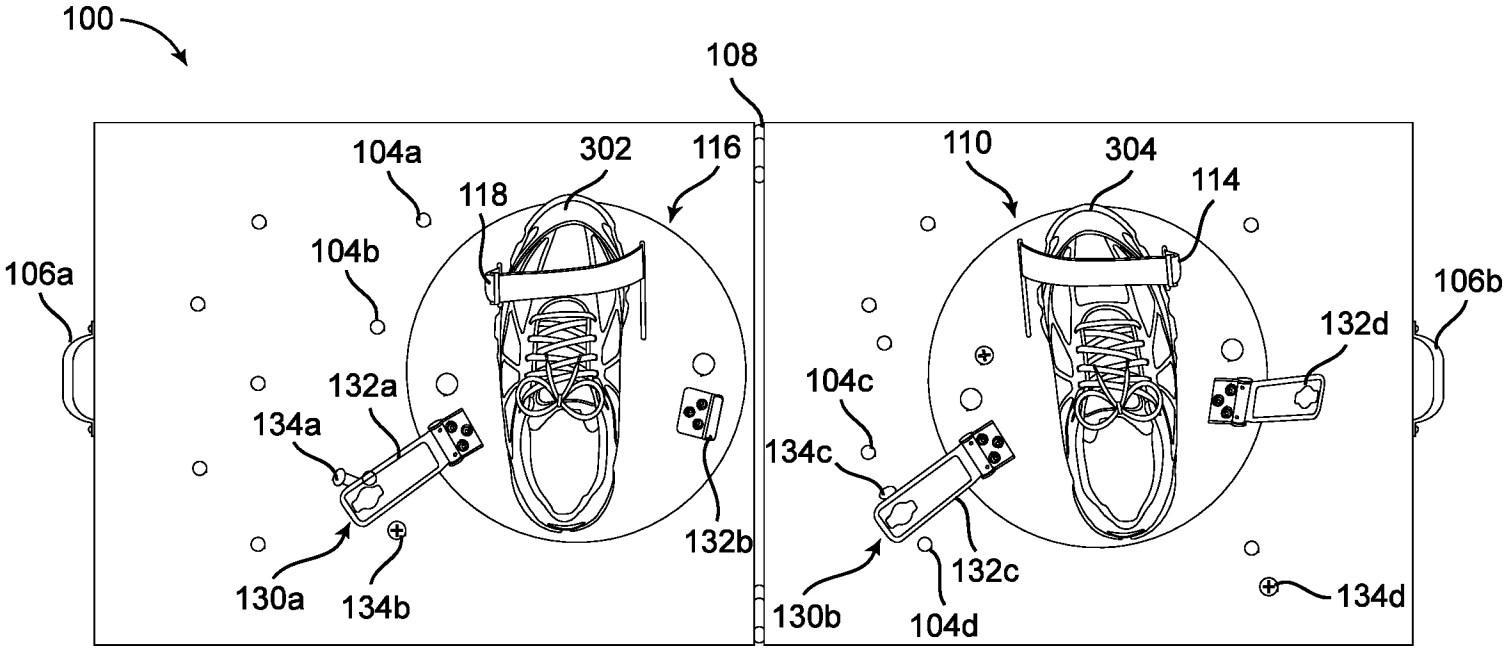
FIGS. 2A and 2B illustrate a top view of the golf swing training assembly shown in FIG. 1A, showing the Lazy Susan turntables rotating in a left-handed swing motion, where
Figure 2B:
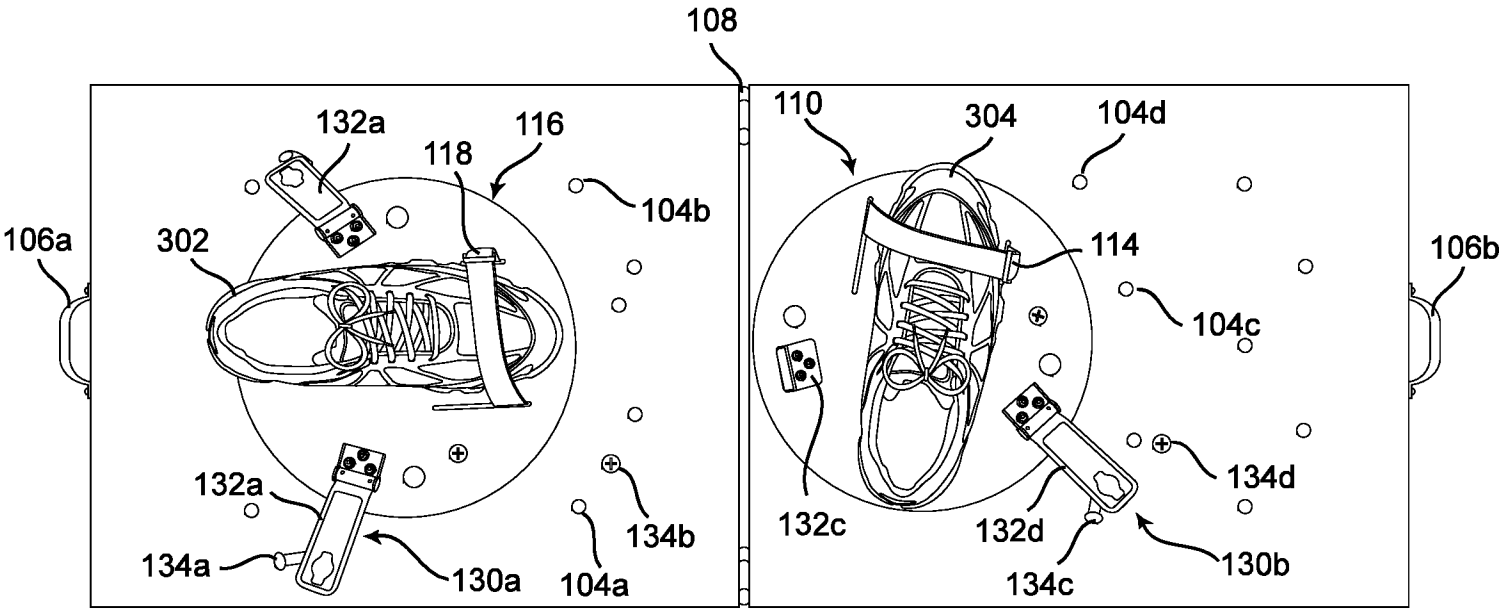

Similarly, the left-handed swing with assembly 100 involves standing with both feet 302, 304 facing forward, at about 90° (FIG. 2A). As the golfer 300 swings the golf club with the left hand driving the golf club, the right foot 304 rotates, turning outwardly, and the right foot Lazy Susan turntable 110 rotates approximately 70°. Simultaneously, the left foot 302 rotates, turning inwardly, and the left foot Lazy Susan turntable 116 rotates approximately 0° (FIG. 2B). In both cases, the amount of foot rotation is adjustable through the rotation restriction mechanism 130*a-b*, discussed below.

As referenced above, both the left and right foot rotatable Lazy Susan turntables 116, 110 are used to support the golfer 300, and rotate to follow the feet in their natural rotational movement during the swing. The Lazy Susan mechanism is configured to enable the golfer's feet 302, 304 to rotate in a limited range, dependent on the desired swing. The limited rotation of the feet during the swing is effective for training the feet, legs, hips, and upper body to achieve the perfect golf swing.

Figure 3A:
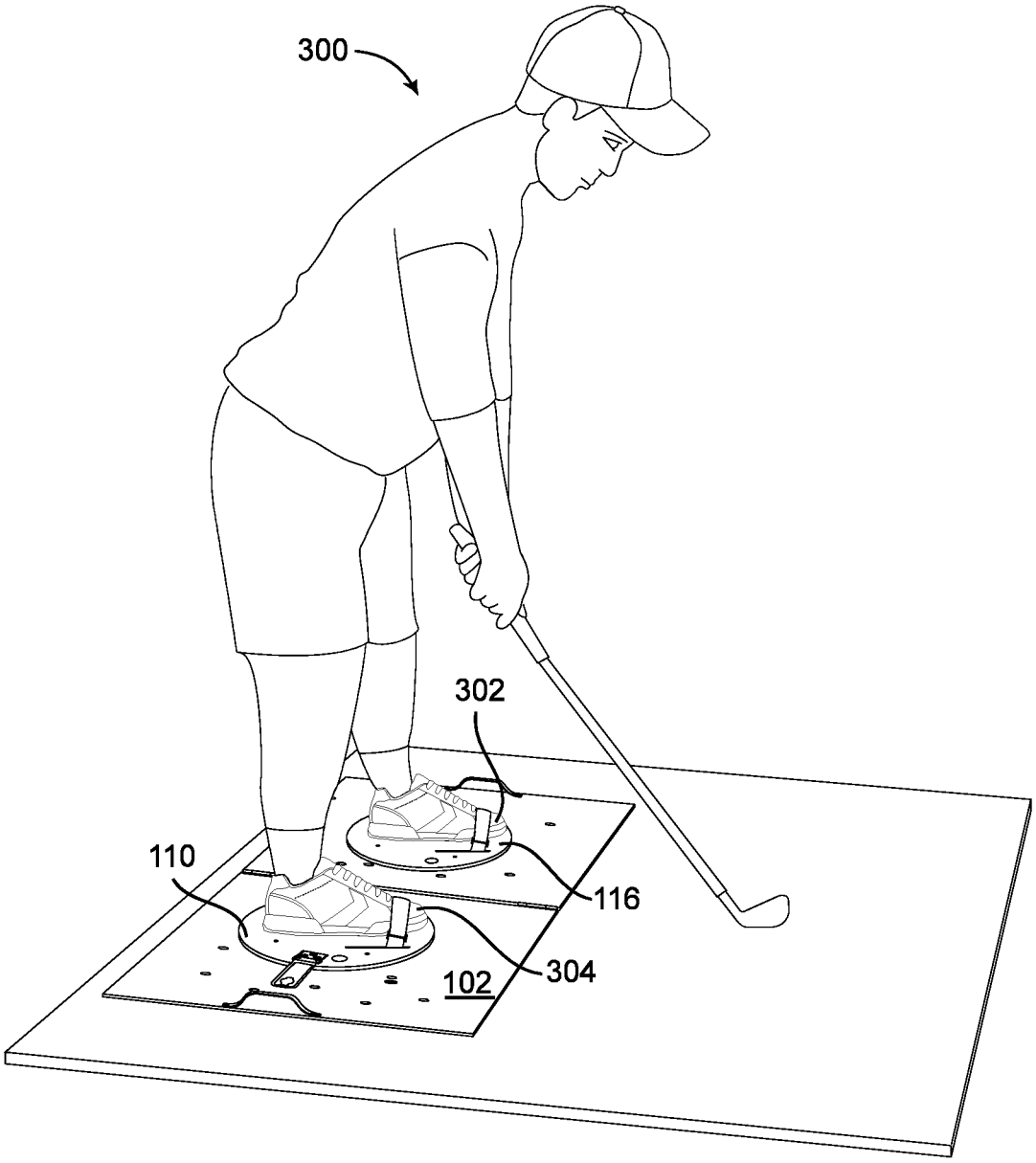
FIGS. 3A, 3B, 3C, and 3D illustrate a perspective view of a golfer performing a swing on the assembly, where
Figure 3B:
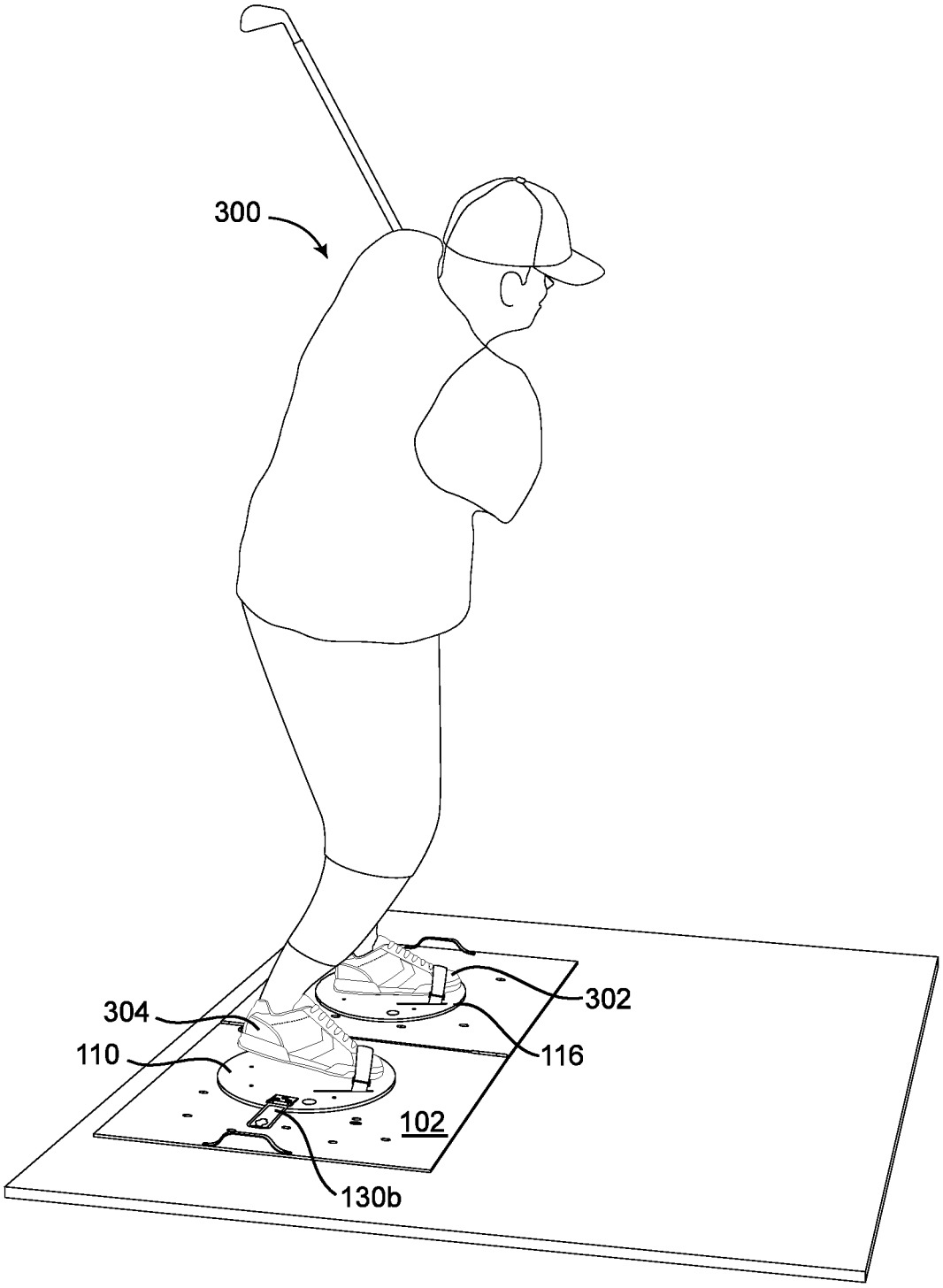

FIG. 3A shows the golfer 300 in the beginning position of the swing, with both feet 302, 304 standing on their respective Lazy Susan turntable 116, 110, and facing forward, about 90°. As the golfer 300 commences with a right-handed swing, the right foot Lazy Susan turntable 110 rotates outwardly, while the left foot Lazy Susan turntable 116 is forced to rotate slightly inwardly (FIG. 3B).

Figure 3C:
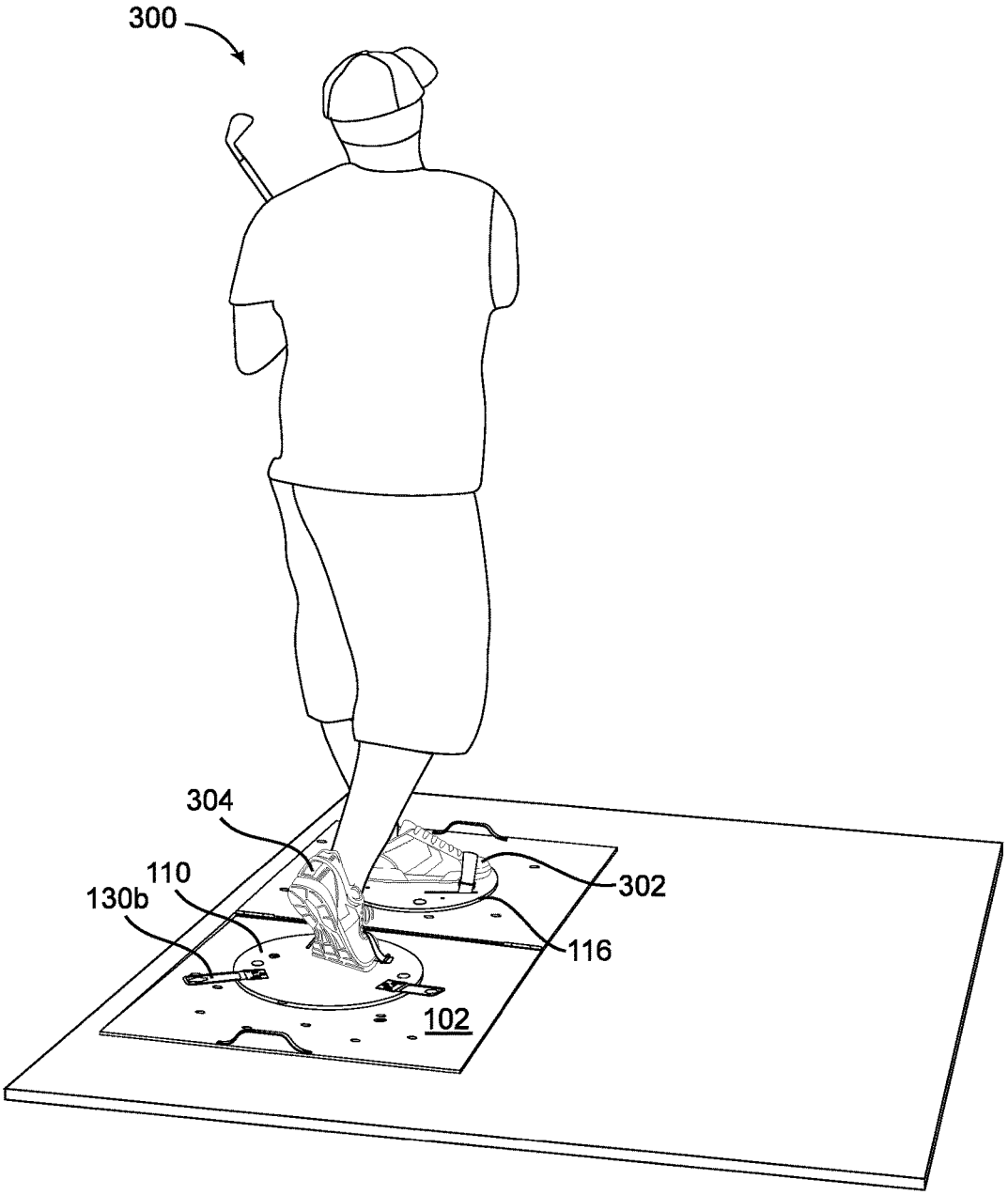

At the finished position, shown in FIG. 3C, the left foot 302 rotates, turning outwardly, and the left foot Lazy Susan turntable 116 rotates approximately 110°. Simultaneously, the right foot 304 rotates, turning inwardly, and the right foot Lazy Susan turntable 110 rotates approximately 180°. The rotation restriction mechanism 130*a-b* positions on the platform 102, so as not to allow the left foot Lazy Susan turntable 116 to rotate beyond 110°, and the right foot Lazy Susan turntable 110 to rotate beyond 180°.

Figure 3D:
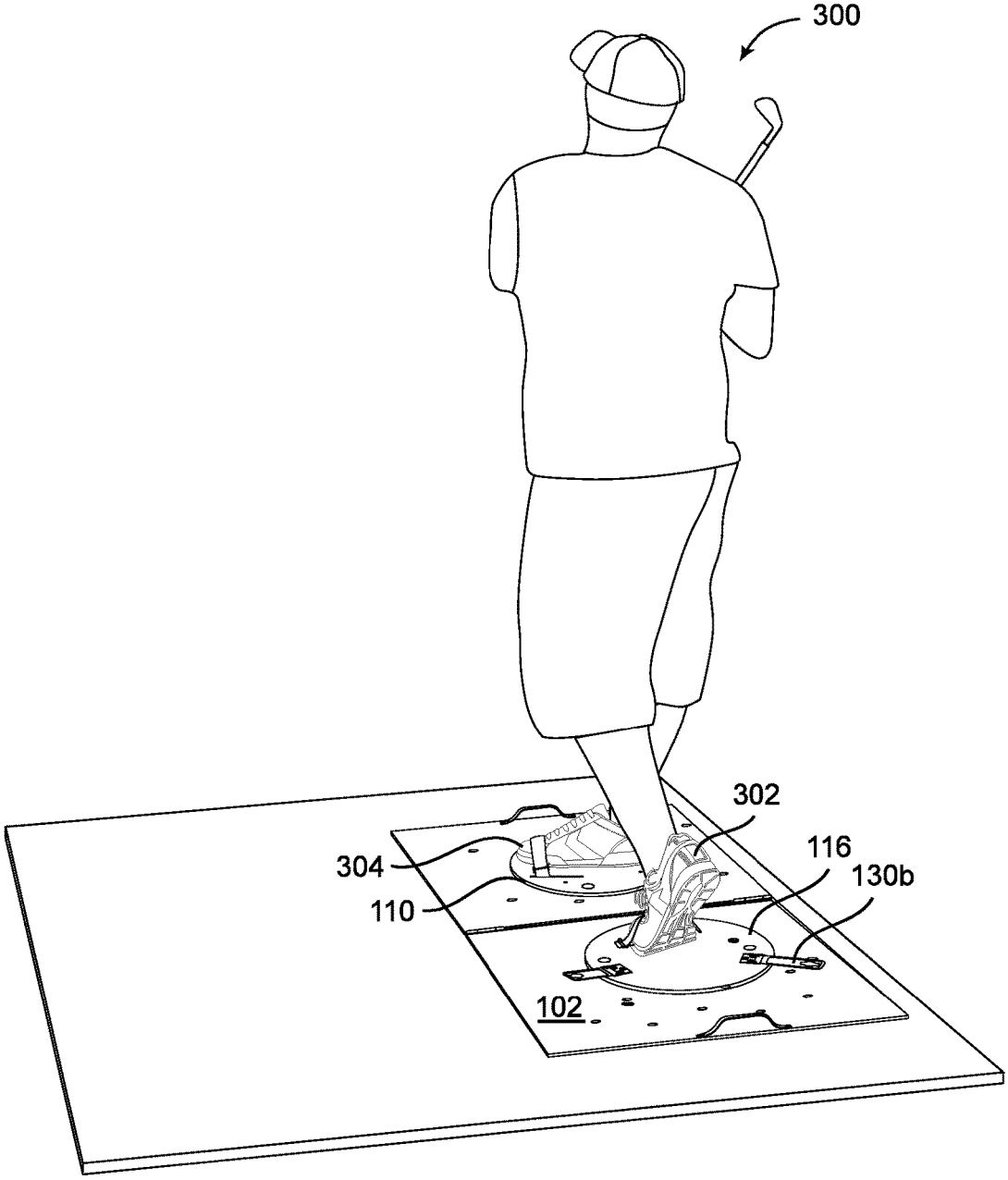

Conversely, FIG. 3D shows the finished left-handed swing position with right foot Lazy Susan turntable rotating approximately 70° and left foot turning inwardly such that left foot Lazy Susan turntable rotates approximately 0°. The golfer is shown in the fully extended position with both feet in their respective orientation after the left-handed swing has been completed. However it is significant to note that the right-handed swinging illustrations (FIGS. 3A-3C) of the right-handed golfer are substantially a mirror-image of the left handed-swing (FIG. 3D); whereby this is just one example of a left-handed golfer using the assembly 100.

Figure 4A:
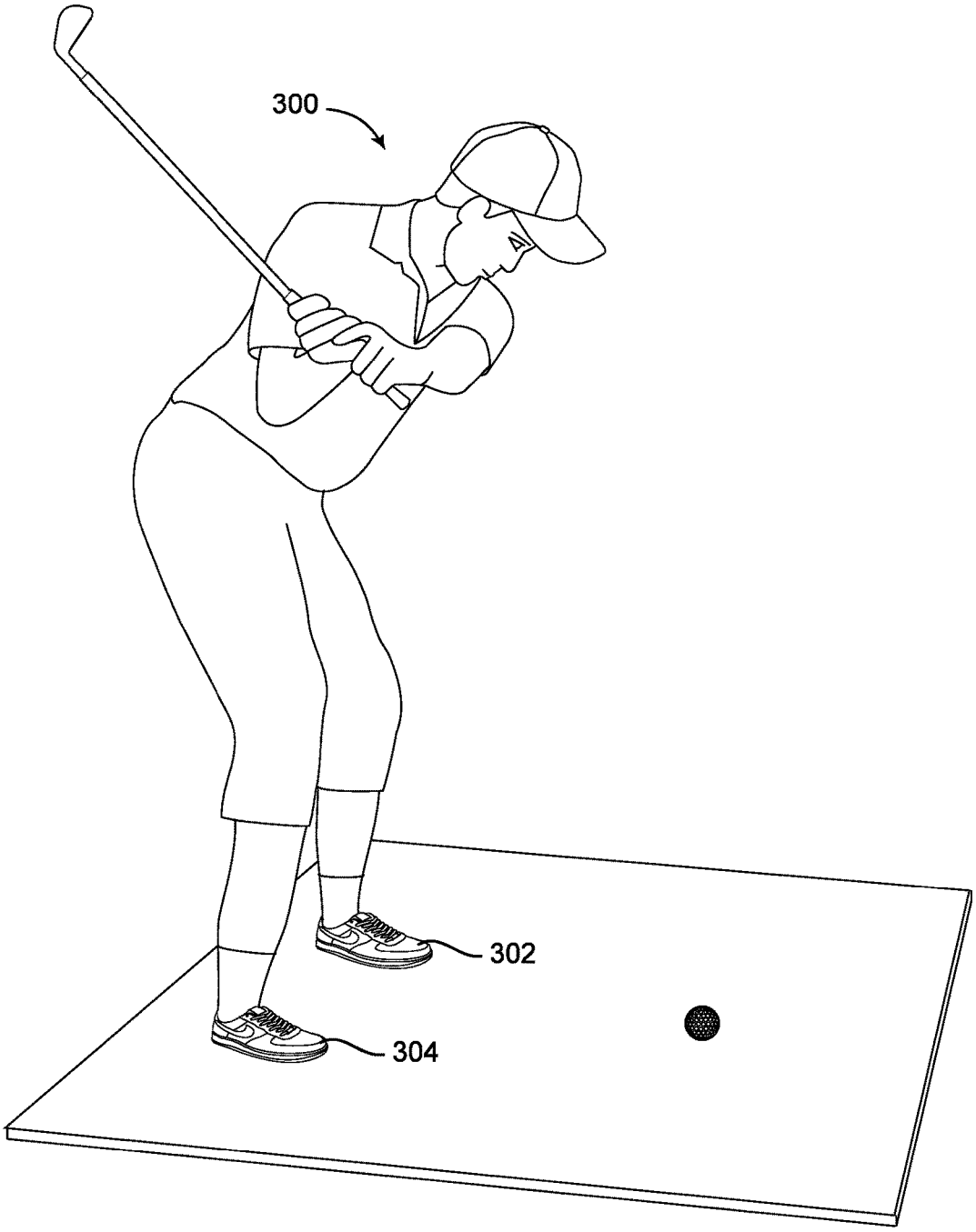
FIGS. 4A and 4B illustrate a perspective view of a golfer performing a right-handed swing without the assembly, where
Figure 4B:
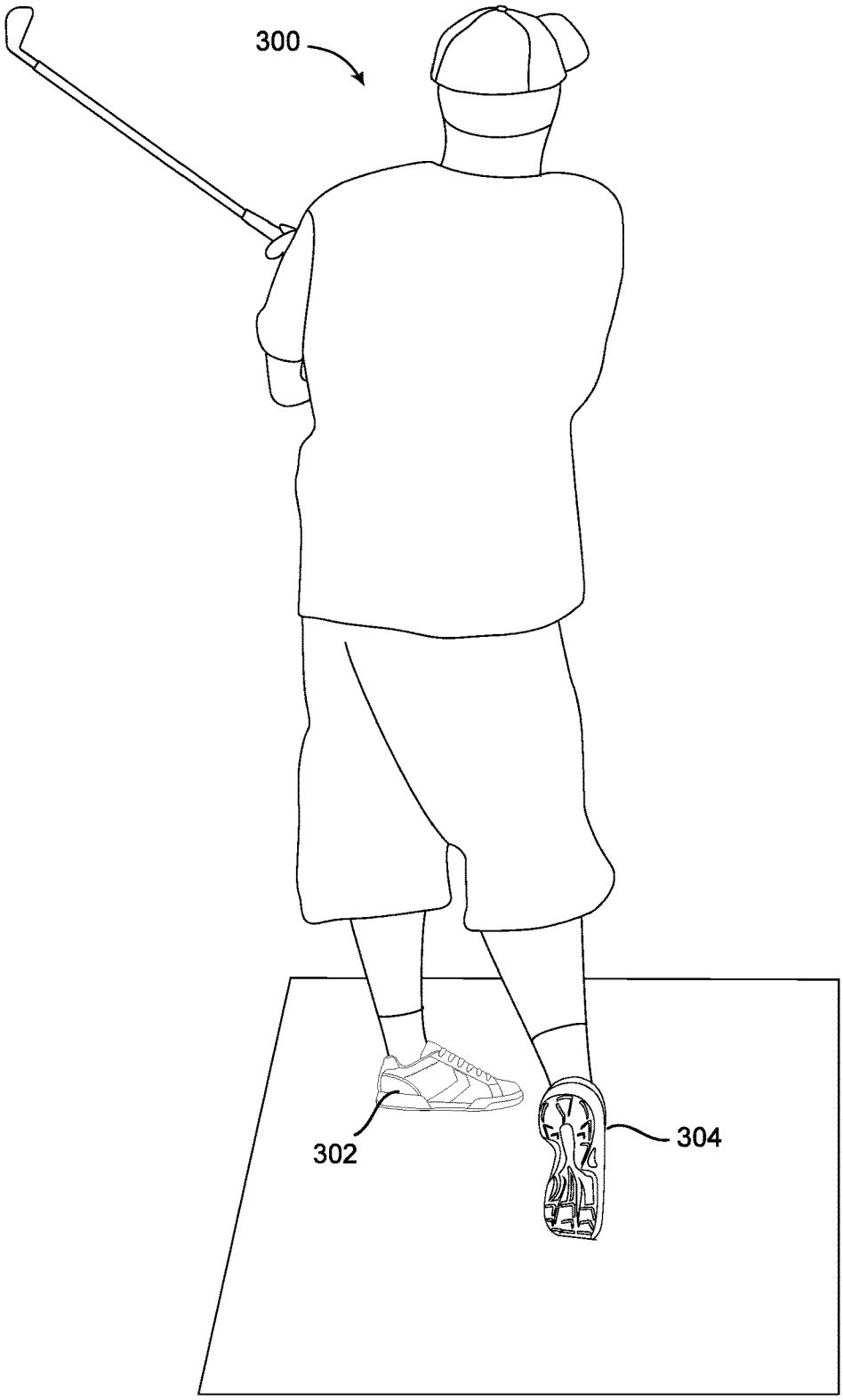

FIG. 4A shows golfer 300 performing a right-handed swing without help of the assembly 100. Upon swinging the golf club, the right foot 304 rotates beyond 180°, causing the golf ball to be driven inaccurately. The left foot 302 is also extended beyond the desired 110° inward rotation, creating excess torque on the back and leaving the golfer 300 in an awkward finished position (FIG. 4B), chiefly because foot rotation is not restricted at a predetermined rotational range.

It is significant to note that, although the dictionary definition of a Lazy Susan describes a large, revolving tray for food, placed at the center of a dining table; the term "Lazy Susan" has generically come to refer to a number of different types of rotatable storage or supporting devices. The term "Lazy Susan" will be used herein in its generic sense to refer to a rotatable support that supports the weight of a user while rotating in conformance with the motion of the feet; and should not be construed to be limited to devices in accordance with its dictionary definition.

In one non-limiting embodiment, referenced in FIGS. 1A and 1B, the assembly 100 comprises a platform 102 that forms a static, supportive surface for the golfer 300 and other components to rest on during operation of assembly 100. In one non-limiting embodiment, platform 102 is sufficiently durable to support the weight of a golfer 300 up to three-hundred pounds, plus the additional weight of the components of assembly 100. Further, platform 102 may have a surface similar to natural turf yet is not destroyed with each strike of the club at the golf ball. In non-limiting embodiments, platform 102 is rectangular and constructed from a rigid material, such as a rigid polymer, aluminum, and wood.

Platform 102 may be defined by at least one hole 104*a*, 104*b*, 104*c*, 104*d*. Hole 104*a-d* may include multiple openings or cavities that form along the surface of platform 102. Hole 104*a-d* is used to anchor and reposition other components of assembly 100, Lazy Susan turntables 110, 116, rotation restriction mechanism 130*a-b*, generally anywhere along the surface of platform 102.

In another non-limiting embodiment, platform 102 is adapted for portability, so as to be carried to different driving ranges and for efficient storage. For this capacity, the platform 102 is bifurcated along a central hinge 108, and includes a pair of handles 106*a*, 106*b* extending from the platform 102. For example, platform 102 may be folded in half and carried by the handles 106*a-b*.

Assembly 100 further comprises a left foot Lazy Susan turntable 116 that is rotatable in two directions, and up to 360° relative to platform 102. Left foot Lazy Susan turntable 116 is configured to receive and rotate with the left foot 302. In operation, the golfer 300 positions the left foot 302 on the left foot Lazy Susan turntable 116 to practice a golf stance, a back swing, a down swing, and general body position when striking a golf ball. Golfer 300 initiates the golf swing, and left foot Lazy Susan turntable 116 rotates to follow the left foot 302 in its natural rotational movement during the swing.

Figure 7A:
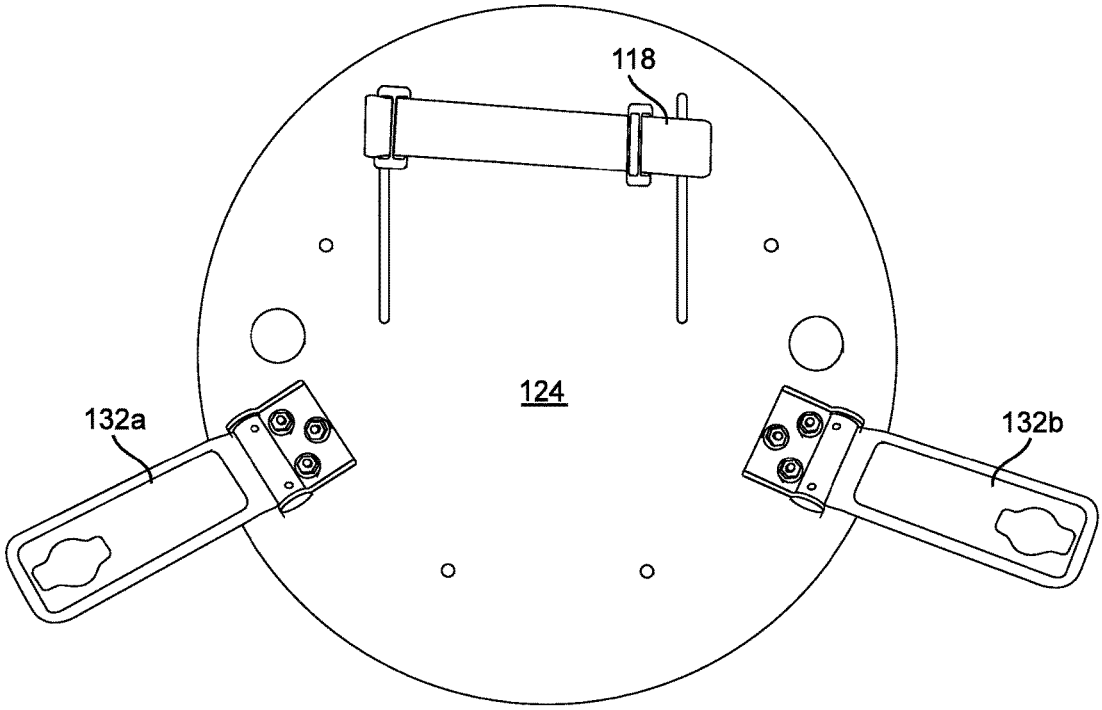
FIGS. 7A and 7B illustrate a top view of exemplary foot support member, where

To help train the feet to the correct position during the swing, a left foot fastener 118 may be used on left foot Lazy Susan turntable 116 to detachably fasten left foot 302 to left foot Lazy Susan turntable 116 during rotation, and to prevent lateral movement by the legs during the golf swing (FIG. 7A). Left foot fastener 118 enables detachable fastening of the left foot 302 to left foot Lazy Susan turntable 116. In one non-limiting embodiment, left foot fastener 118 comprises a hook and loop fastener. Though any strapping or buckling mechanism known in the art may be used as left foot fastener 118.

Adjacent to left foot Lazy Susan turntable 116 on platform 102 is a right foot Lazy Susan turntable 110, which is also rotatable in two directions and up to 360° relative to platform 102. Right foot Lazy Susan turntable 110 is disposed in a spaced-apart, adjacent relationship to the left foot Lazy Susan turntable 116 on the platform 102, which may include shoulder-width distance, or a distance between 6" to 24". Though the position of both Lazy Susan turntables 116, 110 is adjustable on platform, due to holes 104*a-d* that allow for position selectivity.

Right foot Lazy Susan turntable 110 is configured to receive and rotate with the right foot 304. In operation, the golfer 300 positions the right foot 304 on right foot Lazy Susan turntable 110 to practice a golf stance, a back swing, a down swing, and general body position when striking a golf ball. As golfer 300 initiates the golf swing, the right foot Lazy Susan turntable 110 rotates to follow the right foot 304 in its natural rotational movement during the swing. In one non-limiting embodiment, both the left and right foot Lazy Susan turntables 116, 110 are defined by a disc shape having a perimeter 112. Though n other embodiments, Lazy Susan turntables 116, 110 may have other shapes.

To help train the feet 302, 304 to the correct position during the swing, a right foot fastener 114 may be used on right foot Lazy Susan turntable 110 to detachably fasten right foot 304 to right foot Lazy Susan turntable 110 during rotation, and to prevent lateral movement by the legs during the golf swing (FIG. 7A). In one non-limiting embodiment, right foot fastener 114 comprises a hook and loop fastener. Though any strapping or buckling mechanism known in the art may be used.

Figure 5A:
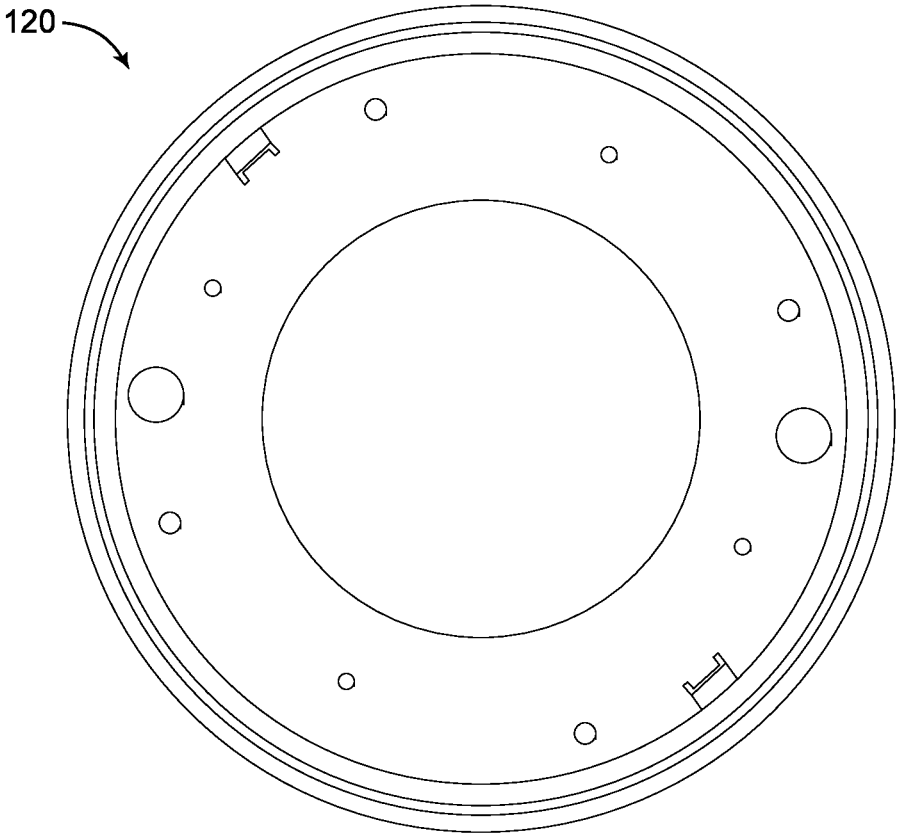
FIGS. 5A and 5B illustrate a top view of exemplary components of a left foot Lazy Suzan turntable, where
Figure 5B:
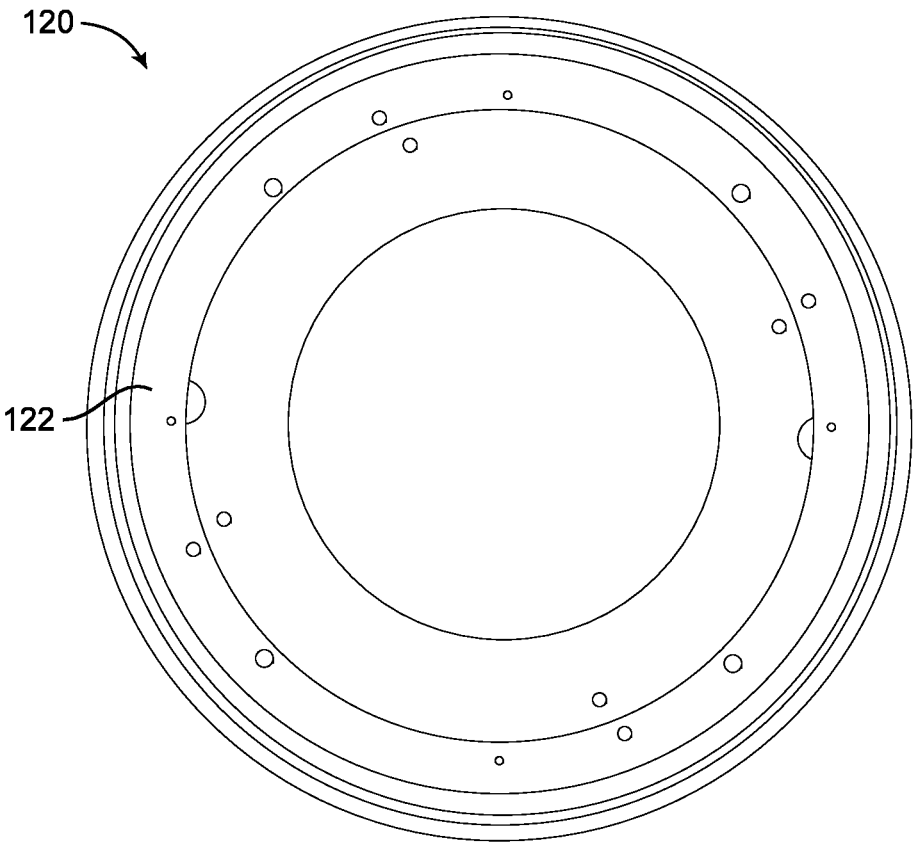
Figure 6:
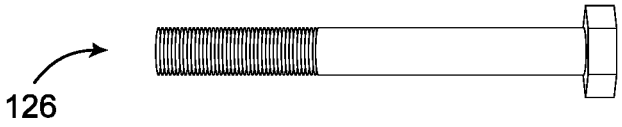
FIG. 6 illustrates a top view of exemplary central axle, in accordance with an embodiment of the present invention.

Looking now at FIGS. 5A, 5B, and 6, Lazy Susan turntables may include multiple components that work together to create the Lazy Susan mechanism, including: a static member 120 detachably attached to platform 102, a rotatable member 122 rotatable with respect to the static member 120, and a foot support member 124 riding the rotatable member 122. Static member 120 may be defined by a disc-shaped metal base having a groove that provides space for rotation of rotatable member 122. FIG. 5A illustrates a rear view of static member 120 showing the disc shape and the groove that provides a space for the rotation by the rotatable member 122.

FIG. 5B illustrates a front view of static member 120 with rotatable member 122 riding in the groove to rotate up to 360°. Foot support member 124 may include a large disc that rests on rotatable member 122, thereby enabling rotation of foot support member 124 in conjunction with rotatable member 122. Foot support member 124 also provides the surface for the feet 302, 304 to rest on during the swing. Further, the foot support member 124 is defined by a central aperture 128 for receiving central axle 126.

In one non-limiting embodiment, static member 120, rotatable member 122, and foot support member 124 are defined by a disc shape. Though in other embodiments, other shapes for static member 120, rotatable member 122, and foot support member 124 may be used.

In one non-limiting embodiment shown in FIG. 6, Lazy Susan turntables 110, 116 further comprise a central axle 126 disposed centrally to the foot support member 124, and upon which rotatable member 122 and foot support member 124 rotate. Central axle 126 fits in the at least one hole 104*a-d* that forms in platform 102, so as to enable repositioning of Lazy Susan turntables 110, 116 anywhere along the surface of platform 102.

Figure 7B:
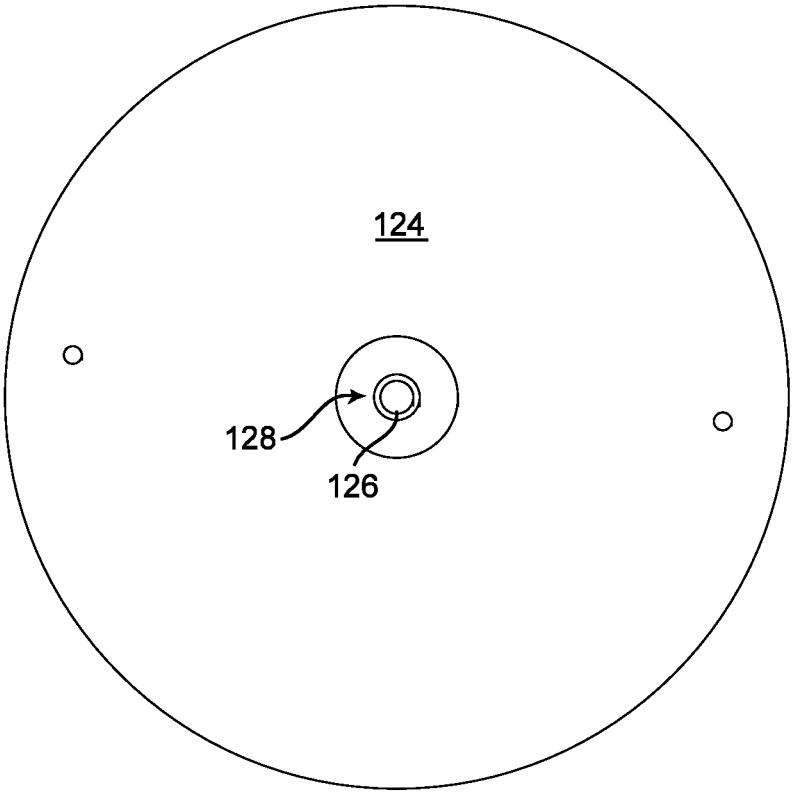

As shown in FIG. 7B, foot support member 124 is defined by a central aperture 128 for receiving central axle 126. In this manner, foot support member 124 and rotatable member 122 rotates about central axle 126. In one embodiment, central axle 126 is a threaded bolt. Though any elongated axle-like member may be used. In other embodiments, different components and mechanisms known in the art of Lazy Susan mechanisms may be used to rotate both left and right foot Lazy Susan turntables 116, 110.

Turning again to FIG. 7A, assembly 100 further comprises a rotation restriction mechanism 130*a*, 130*b* that integrates with platform 102, and with both left and right foot Lazy Susan turntables 116, 110. Rotation restriction mechanism 130*a-b* works to selectively restrict rotation of Lazy Susan turntables 110, 116 relative to platform 102. Thus, the allowed rotational range of Lazy Susan turntables 110, 116—and thereby the rotation of the feet 302, 304—can be adjusted through manipulation of rotation restriction mechanism 130*a-b*. This restrictive rotational aspect of assembly 100 is effective for training rotation of the feet 302, 304, legs, and hips, enhancing muscle memory, and also accommodating different types of swings and body sizes.

In one non-limiting embodiment, rotation restriction mechanism 130*a-b* comprises a pair of hasps 132*a*, 132*b*, 132*c*, 132*d* that fixedly attach to each of the outer region of Lazy Susan turntables 110, 116. Hasps 132*a-d* pivotally extend and retract along a hinge. In this manner, hasps 132*a-d* may hingedly extend beyond the perimeter of Lazy Susan turntables 110, 116, or may hingedly retract within the perimeter of Lazy Susan turntables 110, 116.

Rotation restriction mechanism 130*a-b* further comprises at least one restriction bar 134*a*, 134*b*, 134*c*, 134*d* that detachably fits into the at least one hole 104*a-d* that forms in platform 102. Restriction bar 134*a-d* engages extended hasp 132*a* during its rotation to restrict further rotation in that direction. By enabling selective positioning of restriction bar 134*a* in this manner, the range of rotation by Lazy Susan turntables 110, 116 may be adjusted.

In operation of rotation restriction mechanism 130*a-b*, the hasp 132*a* is extended to engage the restriction bar 134*a*, and thereby restrict rotation in that direction. Multiple hasps 132*a-b* and restriction bars 134*a-d* may be used to restrict rotation of Lazy Susan turntables in two directions. Further, the position of restriction bar 134*a-d* that is fitted in hole 104*a-d* forming in platform 102 may be reconfigured to increase or decrease the rotation of Lazy Susan turntables 110, 116.

For example, for the left-handed swing, the left foot 302 rotates, turning outwardly, and left foot Lazy Susan turntable 116 rotates approximately 110°, where the extended hasp 132*b* engages the restriction bar 134*b*. To decrease the rotation of the left foot 302, the restriction bar 134*b* may be moved to the at least one hole 104*b* forming in platform 102 that is more to the left of the left foot 302 by a few inches. In this new restrictive configuration, left foot Lazy Susan turntable 116 is then restricted from rotation at less than 110°.

FIGS. 1B and 2B provide illustrations that show the rotation of the Lazy Susan turntables 110, 116 being restricted as the hasps 132*a-d* engage the restriction bars 134*a-d*. This restrictive rotation may be useful for customizing the type of golf swing to accommodate different body types and golfing abilities, or accommodating swinging motions for other sports. Further, at least one rotation restriction mechanism 130*a-b* may also be operable with the Lazy Susan turntables to restrict or limit the rotation of Lazy Susan turntables 110, 116 relative to platform 102.

In this manner, assembly 100 aligns the feet at a perfect golf stance at a beginning position. Assembly 100 allows the feet 302, 304 and body to shift into the correct swing based on body type and desired swing type. Assembly 100 allows focus on striking the golf ball. Assembly 100 also helps develop body positioning and muscle memory during the swing, so as to correct: inconsistent stances; inconsistent ball strikes; inconsistent direction; and inconsistent follow through.

Further, assembly 100 works to automatically align the feet of a golfer 300 at a perfect golf stance at set position; and automatically allow the feet and the body to shift into a perfect finish swing based on the golfer's body type. Further, assembly 100 helps train the feet to the correct position during a golf swing, and also prevents lateral movement by the legs during the golf swing.

Figure 8A:
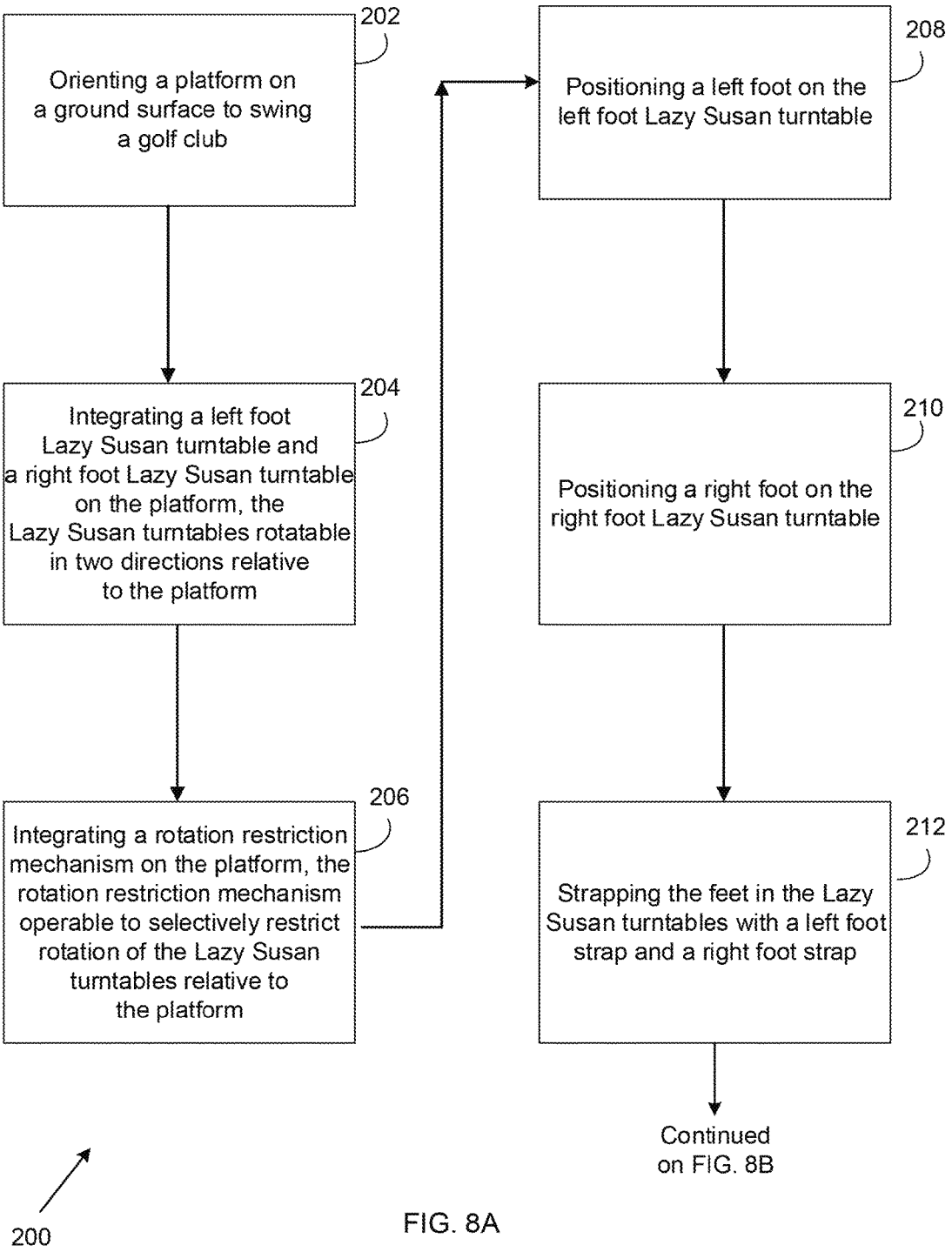
FIGS. 8A and 8B illustrate flowchart diagrams of an exemplary method for operation of a golf swing training assembly, in accordance with an embodiment of the present invention.
Figure 8B:
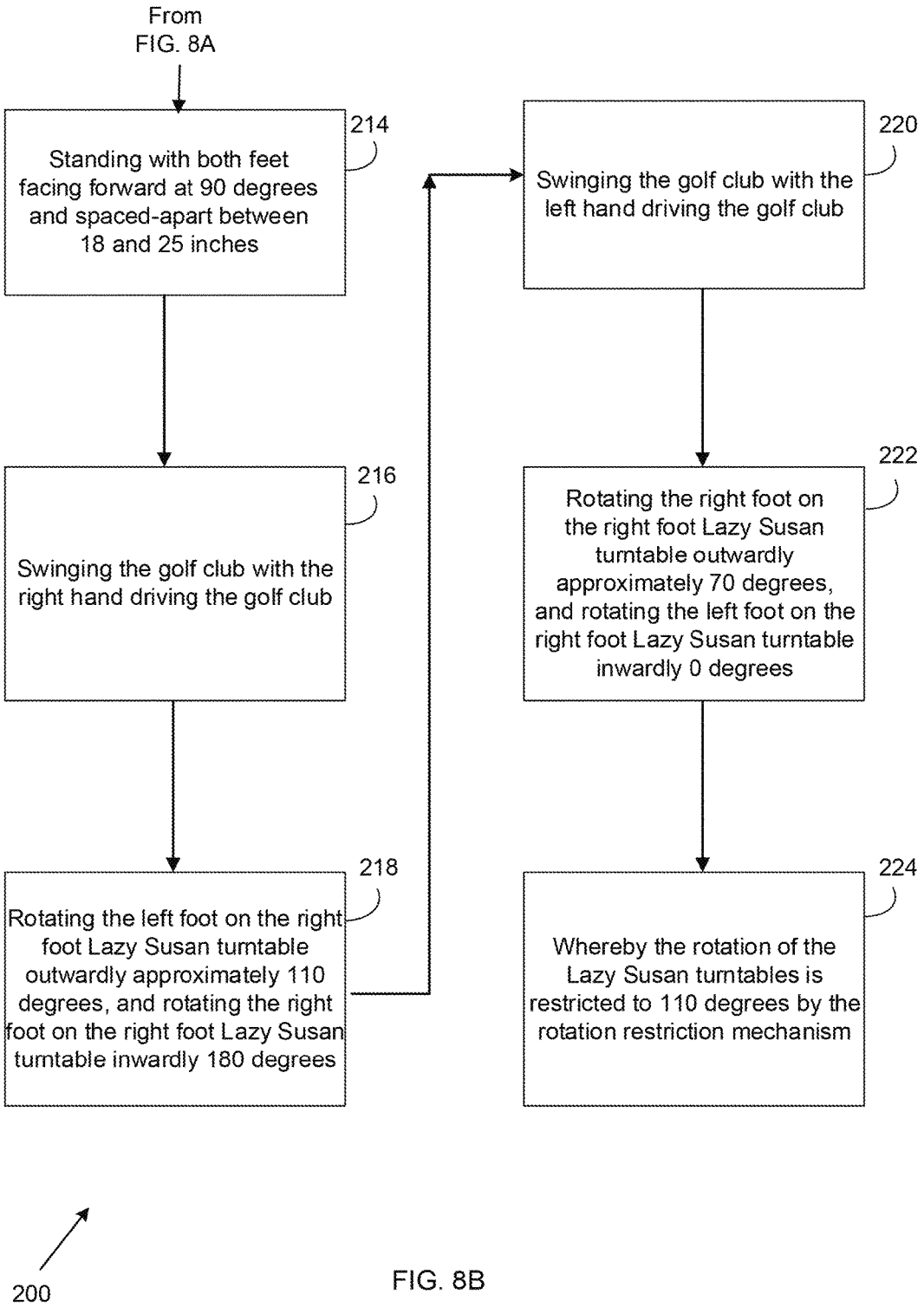

FIGS. 8A and 8B illustrate a flowchart diagram of an exemplary method 200 for operating a golf swing training assembly 100. Method 200 of operation is effective for aligning the feet of a golfer 300 at a perfect golf stance; and also allowing the feet and the body to shift into a correct finish swing.

Method 200 utilizes a platform 102 that forms a static foundation upon which the golfer 300 stands. A left foot Lazy Susan turntable 116 and a right foot Lazy Susan turntable 110 are operable on the platform 102 to rotate about a central axle 126 in two directions relative to the static platform 102 to accommodate a traveling foot of golfer 300 while swinging.

In process of method 200, the golfer 300 positions the left foot and right foot on their respective Lazy Susan turntable to practice a golf stance or swing. A left and right foot fastener 118, 114 on each Lazy Susan turntable 116, 110 detachably fastens feet 302, 304 to their respective Lazy Susan turntables 116, 110 during swing rotation to prevent lateral movement by legs during the golf swing. Method also utilizes at least one rotation restriction mechanism 130*a-b* to restrict rotation of the Lazy Susan turntables 110, 116 relative to platform 102.

In one non-limiting embodiment, method 200 may include an initial Step 202 of orienting a platform on a ground surface to swing a golf club. In one non-limiting embodiment, method 200 may further comprise a Step 204 of integrating a left foot Lazy Susan turntable and a right foot Lazy Susan turntable on the platform, the Lazy Susan turntables rotatable in two directions relative to the platform. A Step 206 includes integrating a rotation restriction mechanism on the platform, the rotation restriction mechanism operable to selectively restrict rotation of the Lazy Susan turntables relative to the platform.

In one non-limiting embodiment, a Step 208 comprises positioning a left foot on the left foot Lazy Susan turntable. A Step 210 includes positioning a right foot on the right foot Lazy Susan turntable. A Step 212 comprises strapping the feet in the Lazy Susan turntables with a left foot fastener and a right foot fastener. In one non-limiting, a Step 214 comprises standing with both feet facing forward at 90° and spaced-apart between 18 to 25 inches. A Step 216 includes swinging the golf club with the right hand driving the golf club.

In one non-limiting, a Step 218 may include rotating the left foot on the right foot Lazy Susan turntable outwardly approximately 110°, and rotating the right foot on the right foot Lazy Susan turntable inwardly approximately 180°. A Step 220 comprises swinging the golf club with the left hand driving the golf club. A Step 222 may include rotating the right foot on the right foot Lazy Susan turntable outwardly approximately 70°, and rotating the left foot on the right foot Lazy Susan turntable inwardly approximately 0°. A final Step 224 of method 200 is, whereby the rotation of the Lazy Susan turntables is restricted to 110° by the rotation restriction mechanism. This restriction of rotation by the feet is the essence of the training for a swing.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A swing training assembly, the assembly comprising:

a platform;

a left foot Lazy Susan turntable rotatable in two directions relative to the platform;

a right foot Lazy Susan turntable rotatable in two directions relative to the platform, the right foot Lazy Susan turntable disposed in a spaced-apart, adjacent relationship to the left foot Lazy Susan turntable on the platform;

a left foot fastener disposed on the left foot Lazy Susan turntable, the left foot fastener enabling detachable fastening of a left foot to the left foot Lazy Susan turntable;

a right foot fastener disposed on the right foot Lazy Susan turntable, the right foot fastener enabling detachable fastening of a right foot to the right foot Lazy Susan turntable; and a rotation restriction mechanism operable to selectively restrict rotation of the Lazy Susan turntables relative to the platform; wherein the rotation restriction mechanism comprises a pair of hasps fixedly attached to the Lazy Susan turntables, the pair of hasps hingedly extending beyond the perimeter of the Lazy Susan turntables, the pair of hasps hingedly retracting within the perimeter of the Lazy Susan turntables, the rotation restriction mechanism further comprising at least one restriction bar detachably attached in the platform.

2. The assembly of claim 1, wherein the platform is bifurcated along a central hinge.

3. The assembly of claim 1, wherein the platform further includes a pair of handles.

4. The assembly of claim 1, wherein the platform is defined by at least one hole.

5. The assembly of claim 1, wherein the Lazy Susan turntables comprise a static member detachably attached to the platform, a rotatable member rotatable with respect to the static member, a foot support member riding the rotatable member, and a central axle disposed centrally to the foot support member.

6. The assembly of claim 5, wherein the central axle is fixedly attached in the at least one hole forming in the platform.

7. The assembly of claim 6, wherein the foot support member is defined by a central aperture for receiving the central axle, whereby the foot support member rotates about the central axle.

8. The assembly of claim 7, wherein the static member, the rotatable member, and the foot support member are defined by a disc shape.

9. The assembly of claim 1, wherein the Lazy Susan turntables are defined by a disc shape having a perimeter.

10. The assembly of claim 9, wherein the extended pair of hasps engage the at least one restriction bar to restrict rotation of the Lazy Susan turntables.

11. The assembly of claim 10, wherein the at least one restriction bar detachably fits into the at least one hole that forms in the platform.

12. The assembly of claim 1, wherein the foot fasteners comprise a hook and loop fastener.

13. A golf swing training assembly, the assembly consisting of:

a platform defined by at least one hole, the platform adapted to be bifurcated along a central hinge;

a pair of handles extending from the platform;

a left foot Lazy Susan turntable rotatable in two directions relative to the platform;

a right foot Lazy Susan turntable rotatable in two directions relative to the platform, the right foot Lazy Susan turntable disposed in a spaced-apart, adjacent relationship to the left foot Lazy Susan turntable on the platform;

whereby the Lazy Susan turntables comprise a static member detachably attached to the platform, a rotatable member rotatable with respect to the static member, a foot support member riding the rotatable member, and a central axle disposed centrally to the foot support member;

a left foot fastener disposed on the left foot Lazy Susan turntable, the left foot fastener enabling detachable fastening of a left foot to the left foot Lazy Susan turntable;

a right foot fastener disposed on the right foot Lazy Susan turntable, the right foot fastener enabling detachable fastening of a right foot to the right foot Lazy Susan turntable;

whereby the foot fasteners comprise a hook and loop fastener; and a rotation restriction mechanism operable to selectively restrict rotation of the Lazy Susan turntables relative to the platform, the rotation restriction mechanism comprising a pair of hasps fixedly attached to the Lazy Susan turntables, the pair of hasps hingedly extending beyond the perimeter of the Lazy Susan turntables, the pair of hasps hingedly retracting within the perimeter of the Lazy Susan turntables, the rotation restriction mechanism further comprising at least one restriction bar detachably attached in the platform.

14. The assembly of claim 13, wherein the central axle is fixedly attached in the at least one hole forming in the platform.

15. The assembly of claim 13, wherein the foot support member is defined by a central aperture for receiving the central axle, whereby the foot support member rotates about the central axle.

16. The assembly of claim 13, wherein the static member, the rotatable member, and the foot support member are defined by a disc shape.

17. The assembly of claim 13, wherein the extended pair of hasps engage the at least one restriction bar to restrict rotation of the Lazy Susan turntables.

18. The assembly of claim 13, wherein the at least one restriction bar detachably fits into the at least one hole that forms in the platform, whereby the rotation of the Lazy Susan turntables is restricted to 110 degrees by the rotation restriction mechanism.

19. A method for operation of a golf swing training assembly, the method comprising:

orienting a platform on a ground surface to swing a golf club;

integrating a left foot Lazy Susan turntable and a right foot Lazy Susan turntable on the platform, the Lazy Susan turntables rotatable in two directions relative to the platform;

wherein the left foot Lazy Susan turntable is comprised of a static member detachably attached to the platform, a rotatable member rotatable with respect to the static member, a foot support member riding the rotatable member, and a central axle disposed centrally to the foot support member relative to the platform;

wherein the right foot Lazy Susan turntable is comprised of a static member detachably attached to the platform, a rotatable member rotatable with respect to the static member, a foot support member riding the rotatable member, and a central axle disposed centrally to the foot support member relative to the platform;

integrating a rotation restriction mechanism on the platform, the rotation restriction mechanism operable to selectively restrict rotation of the Lazy Susan turntables relative to the platform;

positioning a left foot on the left foot Lazy Susan turntable;

positioning a right foot on the right foot Lazy Susan turntable;

strapping the feet in the Lazy Susan turntables with a left foot fastener and a right foot fastener;

standing with both feet facing forward at 90 degrees and spaced-apart between 18 to 25 inches;

swinging the golf club with the right hand driving the golf club;

rotating the left foot on the right foot Lazy Susan turntable outwardly approximately 110 degrees, and rotating the right foot on the right foot Lazy Susan turntable inwardly approximately 180°;

swinging the golf club with the left hand driving the golf club;

rotating the right foot on the right foot Lazy Susan turntable outwardly approximately 70 degrees, and rotating the left foot on the right foot Lazy Susan turntable inwardly approximately 0°; and whereby the rotation of the Lazy Susan turntables is restricted to 110 degrees by the rotation restriction mechanism.

* * * * *